US008807410B2

(12) United States Patent
Zielberg et al.

(10) Patent No.: US 8,807,410 B2
(45) Date of Patent: Aug. 19, 2014

(54) CARRYING STRAP HAVING AN EVER-READY CASE

(75) Inventors: Oliver Zielberg, Wetzlar (DE); Stefan Daniel, Dillenburg (DE)

(73) Assignee: Leica Camera AG, Solms (DE)

( * ) Notice: Subject to any disclaimer, the term of this patent is extended or adjusted under 35 U.S.C. 154(b) by 19 days.

(21) Appl. No.: 13/223,491

(22) Filed: Sep. 1, 2011

(65) Prior Publication Data

US 2012/0055969 A1 Mar. 8, 2012

(30) Foreign Application Priority Data

Sep. 7, 2010 (DE) ..... 10 2010 044 575

(51) Int. Cl.
*A45F 3/02* (2006.01)

(52) U.S. Cl.
USPC ..... 224/604; 224/197; 224/600

(58) Field of Classification Search
CPC ..... A45C 11/08; A45C 11/38; A45C 13/30; A45F 3/02; A45F 3/14; A45F 5/00; A45F 2003/02; A45F 2003/002; A45F 2003/025
USPC ..... 224/197, 223, 257, 600, 602–604, 607, 224/614, 626, 647, 684, 908; 396/420, 423
See application file for complete search history.

(56) References Cited

U.S. PATENT DOCUMENTS

| | | | | | |
|---|---|---|---|---|---|
| 667,082 | A | * | 1/1901 | Gibson | 224/603 |
| 1,884,328 | A | * | 10/1932 | Sperling | 224/587 |
| 2,290,307 | A | * | 7/1942 | Wicker | 312/30 |
| 2,643,803 | A | * | 6/1953 | Bates | 224/254 |
| 3,931,917 | A | * | 1/1976 | Zellmer | 224/602 |
| D371,457 | S | * | 7/1996 | Jacobs | D3/231 |
| 6,155,471 | A | * | 12/2000 | Lichtenberger | 224/626 |
| 6,568,575 | B1 | * | 5/2003 | Bartholomew | 224/583 |
| 2004/0094592 | A1 | | 5/2004 | Brown | |
| 2005/0184117 | A1 | * | 8/2005 | Brown | 224/623 |
| 2008/0078794 | A1 | | 4/2008 | Fletcher et al. | |

FOREIGN PATENT DOCUMENTS

| | | |
|---|---|---|
| DE | 81 08 184 U1 | 8/1981 |
| EP | 0 910 966 A2 | 4/1999 |

* cited by examiner

*Primary Examiner* — Adam Waggenspack
(74) *Attorney, Agent, or Firm* — Foley & Lardner LLP

(57) ABSTRACT

A carrying strap having an ever-ready case for hand-held optical devices is characterized in that there are provided first (2) and second (3) flat strap parts which are connected together, in each case at one of their ends, in a rotatable manner lying one on the other, such that the second strap part (3) can be rotated with respect to the first strap part (2), in that the free ends of the strap parts (2, 3) can be connected together with a buckle (5, 5', 5") and in that an ever-ready case (6) which is open toward the part (5') of the buckle (5) on the first strap part (2) is fixed to the first strap part (2) in the rotary region of the strap parts (2, 3).

6 Claims, 3 Drawing Sheets

CARRYING STRAP HAVING AN EVER-READY CASE

CROSS-REFERENCE TO RELATED PATENT APPLICATIONS

The right of foreign priority is claimed under 35 U.S.C. §119(a) based on Federal Republic of Germany Application No. 10 2010 044 575.4, filed Sep. 7, 2010, the entire contents of which, including the specification, drawings, claims and abstract, are incorporated herein by reference.

BACKGROUND OF THE INVENTION

The invention relates to a carrying strap having an ever-ready case for hand-held optical devices.

Hand-held optical devices should be understood to mean in particular cameras and binoculars. A great variety of ever-ready cases for these devices are known in the form of individual cases having hand or shoulder straps or else in the form of belts having holsters for accommodating the devices. The containers for the devices are in this case usually provided with a cover or retaining clasp in order to secure the devices against falling out. Removing the devices is thus always associated with additional manipulations, which slow down rapid employment of the devices.

SUMMARY OF THE INVENTION

It is therefore one object of the invention to allow the devices to be carried in a comfortable and secure manner, and such that they can be deployed rapidly.

This object is achieved according to the invention in that there are provided first and second flat strap parts which are connected together, in each case at one of their ends, in a rotatable manner lying one on the other, such that the second strap part can be rotated with respect to the first strap part, in that the free ends of the strap parts can be connected together with a buckle and an ever-ready case which is open toward the buckle on the first strap part is fixed to the first strap part in the rotary region of the two strap parts. Advantageous developments of the invention can be gathered from the features in the dependent claims.

The two strap parts, which can be pivoted with respect to one another, are carried on the body of a person such that the first strap part runs transversely across the chest of the person and the second strap part is oriented via the pivot joint such that it passes through under the armpit of the person and across the back and is connected to the free end of the first strap part in the region of the shoulder by way of a buckle which is known per se. In the region of the pivot joint, the ever-ready case is fixed to the first strap part, which runs across the chest, such that the opening in the ever-ready case is directed toward the shoulder. The carrying strap, consisting of the two parts, rests on a shoulder of the person and the ever-ready case is located in front of the stomach in the direction of the opposite hip of the person. As a result, the optical device inserted into the ever-ready case is in a position which is favorable to handling and is comfortable to carry. The optical device is largely secured against falling out of the ever-ready case, even if the person bends down, and can be removed by the person at any time without obstruction.

On account of the rotatable connection between the two strap parts, the carrying strap can be carried from the right shoulder to the left hip and vice versa, and so the position of the ever-ready case can be oriented in a manner favorable to handling for both right-handed and left-handed people. The arrangement is practical in particular for the nowadays usual one-handed operation of digital cameras, in which the orientation of the object usually takes place via the display, which is held away from the body of the person.

In order to pack up and store the carrying strap, the two strap parts can be pivoted one over the other, thereby giving a compact packing form.

In a preferred embodiment, the second strap part is inserted in a rotatable manner such that it lies between the first strap part and the ever-ready case. The ever-ready case is in this case connected to the first strap part such that this results for the second strap part in a lateral insertion pocket which bounds its rotary region. An advantage here is the continuous surface of the first strap part, which rests firmly against the body of a person, so that pressure points and chafing points on account of the moveable strap part are ruled out. When the carrying strap is put on, the second strap part is already oriented such as to be guided through under the armpit. However, in this embodiment, separate carrying straps have to be provided for right-handed and left-handed people and the compact packing form described cannot be established.

The ever-ready case fixed to the first strap part can be matched to the form of the optical device used in each case. In order to insert a high-quality camera having a lens attached to the casing, a slot-like cutout is expediently introduced into the ever-ready case in order to accommodate the lens, and so the camera casing is enclosed in a form-fitting manner in the ever-ready casing. The shape of the ever-ready case is expediently formed such that the camera can be inserted in the longitudinal direction. This results in further increased security against falling out and the camera casing can be grasped by the person via a hand loop provided on the side of the casing.

The width of the strap part carrying the ever-ready case is matched to the width of the ever-ready case and runs in a trapezoidally narrowing manner toward the buckle. The wider strap part increases carrying comfort in front of the chest and on the hip, in particular in the embodiment having the first strap part that rests continuously against the body. The increased surface area of the first strap part can also be used advantageously for attaching additional holders or pockets for accessory parts, such as batteries, storage media, caps or else additional devices such as cell phones or smart phones.

High-quality leather applications can be provided as material for the strap parts and the ever-ready case.

Further objects, features and advantages of the present invention will become apparent from the detailed description of preferred embodiments that follows, when considered together with the accompanying figures of drawing.

BRIEF DESCRIPTION OF THE DRAWINGS

An exemplary embodiment of the carrying strap according to the invention having an ever-ready case is schematically illustrated in the drawing and described in the following text on the basis of the figures, in which.

DETAILED DESCRIPTION OF THE PREFERRED EMBODIMENTS

Figure 1:
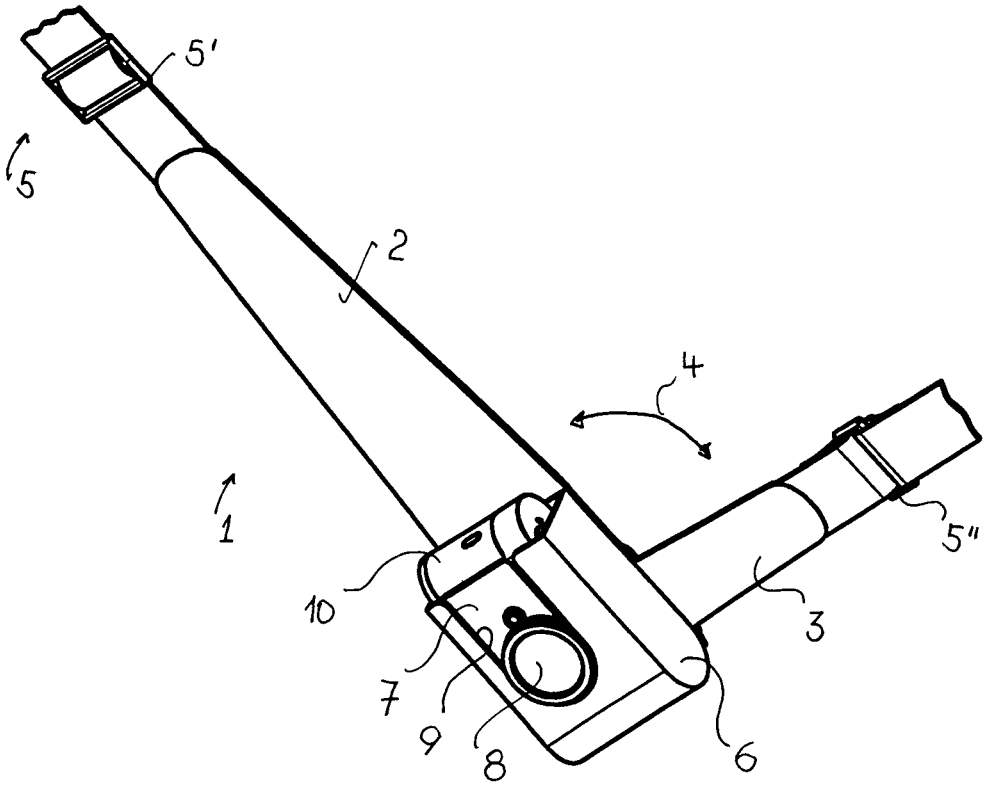
FIG. 1 shows a perspective view of the carrying strap with the ever-ready case and FIG. 2 shows the carrying strap on a person.

The carrying strap 1 illustrated in FIG. 1 includes of a first strap part 2 and a second strap part 3, which lie one on the other at one end and can be rotated with respect to one another in the arrow direction 4. The second strap part 3 can lie under the first strap part 2 or else on top of the latter. The rotary joint (not illustrated) can be a rivet that connects the strap parts 2, 3 or a ring element incorporated into the strap parts 2, 3. In the case in which the strap part 3 lies on the strap part 2, the rotary joint is connected to the rear side of an ever-ready case 6 and the strap part 3. Fixed at the free ends of the strap parts 2, 3 are parts 5', 5" of a buckle 5, the length of which parts 5', 5" can be adjusted.

The ever-ready case 6 is fixed to the first strap part 2 in the region of the rotary joint. In order to introduce the strap part 3 between the ever-ready case 6 and the first strap part 2, the ever-ready case 6 is fixed to the first strap part 2 such that an open insertion pocket remains free at the side. The ever-ready case 6 is open toward the part 5' of the buckle 5. A camera 7 is inserted in its longitudinal direction into the opening in the ever-ready case 6. In this case, the lens 8 of the camera 7 is guided in a slot-like cutout 9. A hand loop 11, which is not illustrated further here and by means of which the camera 7 can be pulled out of the ever-ready case 6, can be fixed to the side part 10, protruding out of the ever-ready case 6, of the housing of the camera 7.

Figure 2:
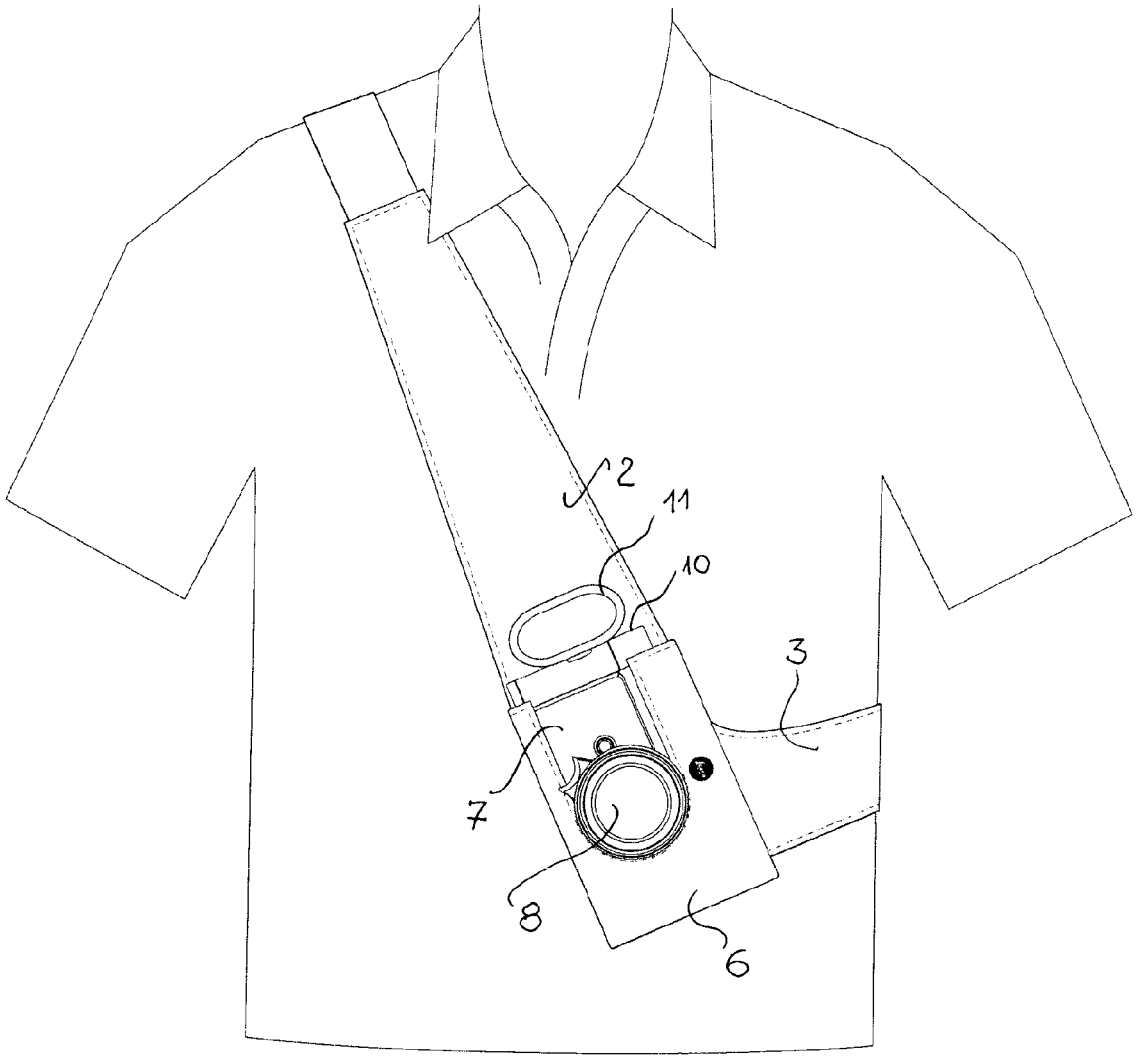
Figure 3:
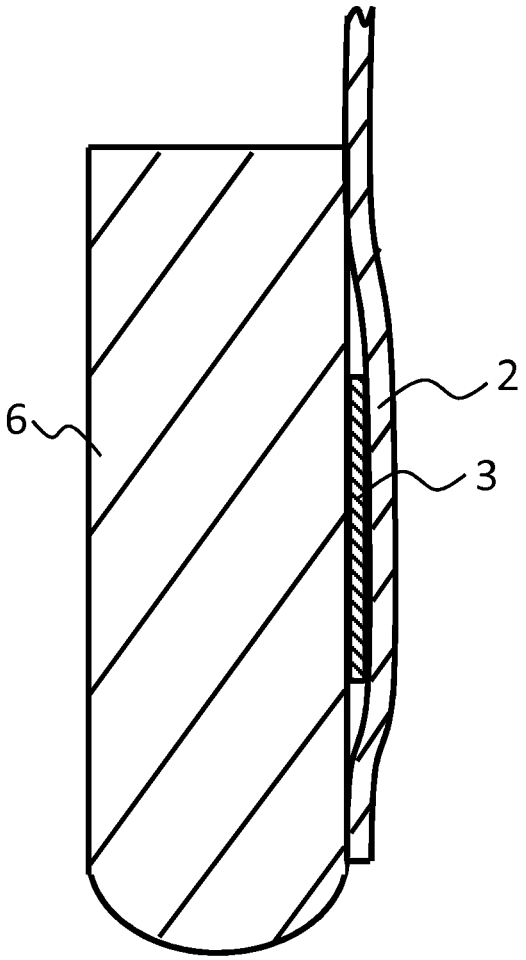
FIG. 3 shows a schematic cross-sectional view of a case, first strap part, and second strap part, taken along a longitudinal axis line of the first strap part when viewed from a side of the case.

FIG. 2 shows the carrying strap 1 resting against the shirt of a person in the carrying position. The camera 7 is illustrated having a hand loop 11 on the side part 10, said hand loop 11 being inclined toward the right hand of the person. The strap part 3 also becomes increasingly wider in the direction of the ever-ready case 6, as a result of which the strap follows the contour of the person's chest more closely.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

LIST OF REFERENCE SIGNS

1 Carrying strap
2 First strap part
3 Second strap part
4 Arrow direction
5 Buckle
6 Ever-ready case
7 Camera
8 Lens
9 Cutout
10 Camera side part
11 Hand loop

What is claimed is:

1. A device comprising:

a carrying strap comprising a first flat strap part configured to extend in a transverse direction across a chest and towards a shoulder of an individual, and a second flat strap part configured to pass under an armpit of the individual;

a case fixed to the first flat strap part, the case having an opening that, when the device is worn, opens towards the shoulder of the individual in the transverse direction in which the first flat strap part extends; and an adjustment device configured to adjust a length of the carrying strap;

wherein a portion of the first flat strap part forms a channel with a rear side of the case, a portion of the second flat strap part is disposed within the channel, and the portion of the second flat strap part within the channel is connected to the portion of the first flat strap part that forms the channel via a rotary joint.

2. The device according to claim 1, wherein:

a width of a portion of the first flat strap part in the region at which the case is fixed to the first flat strap part matches a width of the case, and a width of the first flat strap part decreases in a direction extending away from the case.

3. The device according to claim 1, wherein the case is configured to hold a camera or binoculars.

4. The device according to claim 1, wherein the case, on its outer side, has a slot-like cutout that starts from the opening.

5. The device according to claim 4, wherein the slot-like cutout is configured such that a camera lens is disposable in the slot-like cutout.

6. A device comprising:

a carrying strap comprising a first flat strap part configured to extend in a transverse direction across a chest and towards a shoulder of an individual, and a second flat strap part configured to pass under an armpit of the individual;

a case fixed to the second flat strap part, the case having an opening that, when the device is worn, opens towards the shoulder of the individual in the transverse direction in which the first flat strap part extends; and an adjustment device configured to adjust a length of the carrying strap;

wherein a portion of the second flat strap part forms a channel with a rear side of the case, a portion of the first flat strap part is disposed within the channel, and the portion of the first flat strap part within the channel is connected to the portion of the second flat strap part that forms the channel via a rotary joint.

* * * * *